US006234700B1

(12) United States Patent
Sekiguchi

(10) Patent No.: US 6,234,700 B1
(45) Date of Patent: May 22, 2001

(54) STAMPING IMPLEMENT

(75) Inventor: Naoki Sekiguchi, Tokyo (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/496,071

(22) Filed: Feb. 1, 2000

(30) Foreign Application Priority Data

| | | |
|---|---|---|
| Feb. 4, 1999 | (JP) | 11-027472 |
| Feb. 4, 1999 | (JP) | 11-027717 |
| Feb. 16, 1999 | (JP) | 11-037251 |
| Feb. 19, 1999 | (JP) | 11-041178 |

(51) Int. Cl.[7] ..... B41K 1/00
(52) U.S. Cl. ..... 401/202; 401/48; 101/405
(58) Field of Search ..... 101/104, 105, 101/109, 110, 112, 111, 334, 405; 401/59, 60, 108, 196, 202, 48

(56) References Cited

U.S. PATENT DOCUMENTS

| | | | | |
|---|---|---|---|---|
| 587,726 | * | 8/1897 | Gibbs | 401/48 |
| 1,555,527 | * | 9/1925 | Spielman | 101/110 |
| 5,105,738 | * | 4/1992 | Mehaffey | 101/333 |
| 5,111,745 | * | 5/1992 | Wilson | 101/333 |

FOREIGN PATENT DOCUMENTS

| | | |
|---|---|---|
| 5-5479 | 1/1993 | (JP) . |
| 2519833 | 12/1996 | (JP) . |
| 2552943 | 7/1997 | (JP) . |
| 2583565 | 8/1998 | (JP) . |

* cited by examiner

*Primary Examiner*—Gregory L. Huson
*Assistant Examiner*—Peter deVore
(74) *Attorney, Agent, or Firm*—Darby & Darby

(57) ABSTRACT

A stamping implement includes: a stamp unit having a stamping element made up of a porous stamp compound having continuous pores at the lower end thereof; an outer cylinder having an opening at the lower end thereof, a cutout portion on the side thereof and the stamp unit fixed therein; an inner cylinder having an opening at the lower end thereof a window hole on the side thereof and being arranged outside the stamp unit and inside the outer cylinder with the lower end thereof projected out below the lower end of the outer cylinder so as to be slidable in the vertical direction relative to the outer cylinder; and a lid configured of an arm portion pivoted at an axial support near the upper end thereof and a shield portion at the lower end of the arm portion, and is so constructed that the axial support of the lid is axially supported so as to be rotatable by a frame of the window hole of the inner cylinder, and the lid rotates in linkage with the vertical movement of the inner cylinder relative to the outer cylinder.

7 Claims, 9 Drawing Sheets

STAMPING IMPLEMENT

BACKGROUND OF THE INVENTION (1) Field of the Invention

The present invention relates to a stamping implement including a stamping element made up of a porous stamp compound having continuous pores and an ink retainer for supplying the stamping element with ink.

(2) Description of the Prior Art

Conventionally, a stamping implement called an impregnation stamp which uses a porous stamp compound having continuous pores capable of retaining ink such as sponge rubber etc., and hence does not need application of ink when stamped has been well known.

A stamping implement of this type has a detachable cap for protection of stamping face, hence the operator needs tedious handling of removal and attachment of the cap for every stamping and suffers the problem of their hands being smudged with ink from unintentional touch when the cap is removed and attached and also the losing of the removed cap.

In order to eliminate these problems, a stamping implement with an incorporated lid has been disclosed in the registered publication of Japanese Utility Model No. 2519833, devised by the present applicant. However, this configuration still needs a tedious operation of opening and closing the lid and also may have drawback of the material of the lid being damaged because the lid deforms every time it is opened. There also exists a stamping implement having a rotary lid in order to allow for smooth lid opening and closing. However, this configuration suffers from complicated lid assembly. Further, when the stamping implement is hand-carried, the lid may be opened unintentionally leading to ink smudge or leading to the drawback of the stamping face being damaged or dirtied with dust. Moreover, when the stamping element needs to be replenished with ink or the stamping unit as a whole needs to be replaced, the lid may be the obstacle that makes these operations difficult.

Stamping implements of this type may need the ink retainer to be replenished with ink. Further, the stamping element needs to be exchanged with another one having a different stamping face of characters. However, conventional stamping implements have needed the tedious work of removing the stamping element and/or ink retainer from the barrel body and hence there has been discontent because of the difficulties in performing these tasks.

SUMMARY OF THE INVENTION

It is therefore an object of the present invention to solve the above problems or to provide a stamping implement which offers advantage of allowing its lid to be automatically opened or closed by only vertical movement of the outer cylinder relative to the inner cylinder when stamping, which is free from the problem of the lid being deformed and damaged when it is opened, and which disallows the lid to be unintentionally opened when it is hand-carried and hence prevents ink smudging and the stamping face from being damaged or dirtied due to the unintentional lid opening.

It is another object of the present invention to provide a stamping implement which allows the lid to be locked in the opened state so that the operator can easily refill the stamping element with ink and replace the stamp unit as a whole with another unit.

It is a further object of the present invention to provide a stamping implement with an openable/closable lid in which the thin-walled, delicate shield portion can be reinforced and shaped so as not to be damaged while it still has a good appearance and offers easy lid assembly.

It is still another object of the present invention to provide a stamping implement with an automatic openable/closable lid which has a rotary configuration in order to allow smooth opening and closing and still offers easy lid assembly.

It is a still further object of the present invention to provide a stamping implement which allows the stamping unit to be easily removed from the barrel body in order to facilitate easy ink refill to the ink retainer and easy replacement of a stamping element.

In order to achieve the above object, the present invention is configured as follows:

In accordance with the first aspect of the present invention, a stamping implement includes:

- a stamp unit having a stamping element made up of a porous stamp compound having continuous pores at the lower end thereof;
- an outer cylinder having an opening at the lower end thereof, a cutout portion on the side thereof and the stamp unit fixed therein;
- an inner cylinder having an opening at the lower end thereof a window hole on the side thereof and being arranged outside the stamp unit and inside the outer cylinder with the lower end thereof projected out below the lower end of the outer cylinder so as to be slidable in the vertical direction relative to the outer cylinder; and
- a lid configured of an arm portion pivoted at an axial support near the upper end thereof and a shield portion at the lower end of the arm portion, and is characterized in that the axial support of the lid is axially supported so as to be rotatable by a frame of the window hole of the inner cylinder, and the lid rotates in linkage with the vertical movement of the inner cylinder relative to the outer cylinder, whereby the lower face of the stamping element is shielded when the lid is closed while the lower face of the stamping element is capable of being released when the lid is open.

In accordance with the second aspect of the present invention, the stamping implement having the above first feature further comprises: a supporting cylinder opening at both upper and lower ends disposed inside the outer cylinder; a middle cylinder for a stamp unit removably fitted through the supporting cylinder, the upper end of the middle cylinder being projected above the upper end of the supporting cylinder; and a removable cap attached to the upper end of the outer cylinder.

In accordance with the third aspect of the present invention, the stamping implement having the above first feature further comprises: a U-shaped groove for receiving the axial support of the lid, formed in the frame of the window hole of the inner cylinder; and a cover portion disposed over the frame of the cutout portion of the outer cylinder so as to cover the outside of the U-shaped groove for preventing the axial support from coming off.

In accordance with the fourth aspect of the present invention, the stamping implement having the above first feature is characterized in that a presser portion which abuts and presses the foot piece of the lid in the lid's opening direction when the outer cylinder moves down is provided on the side surface of the supporting cylinder.

In accordance with the fifth aspect of the present invention, the stamping implement having the above first feature is characterized in that side-walls having a projected ridgeline portion are formed around the connection between the shield portion and arm portion of the lid; and the inner cylinder is formed with a depressed ridgeline portion which mates in substantially tight contact with the projected ridgeline portion formed on the lid.

In accordance with the sixth aspect of the present invention, the stamping implement having the above first feature further comprises a locking mechanism between the inner cylinder and outer cylinder for stopping the vertical movement of the inner cylinder relative to the outer cylinder when the lid is open and when the lid is closed.

In accordance with the seventh aspect of the present invention, the stamping implement having the above sixth feature is characterized in that the locking mechanism comprises: a partitioning wall formed on the inner periphery of the inner cylinder; and a locking cylinder disposed in the upper part of the outer cylinder so as to be rotatable within an appropriate range relative to the outer cylinder, and the partitioning wall becomes engaged with the locking cylinder when the locking cylinder is rotated in the lid open or closed state, so that the vertical movement of the inner cylinder relative to the outer cylinder is prohibited.

According to the present invention thus configured, it is possible to provide a stamping implement having a stamping unit which can be repeatedly refilled with ink by using an ink-impregnable, porous stamp compound as the stamping element, and which can further facilitate exchange of the stamping unit.

Further, the present invention allows for automatic opening and closing of the lid for shielding the stamping face in a one handed operation. The locking mechanism for retaining the lid closed state prevents the stamping face from being exposed due to unintentional pressing and hence smudging with ink. Further the locking mechanism for retaining the lid open state facilitates exchange of a stamp unit, ink refill from the front side and cleaning of the stamping face. Although the present invention is configured so that ink is refilled from the rear part of the stamp unit, the ink may be refilled drop-wise from the stamping face side in order to normalize ink starvation of the stamp because the above configuration needs time for ink to reach the stamping face.

The stamping implement of the present invention having the above configuration, can be widely applied as portable, handy stamps for stamping identifications in routine works as personal name, company name, its logotype, date, etc., or recreation-oriented stamps of animation characters for children.

DESCRIPTION OF THE PREFERRED EMBODIMENTS

The embodiment of the present invention will hereinafter be described with reference to the accompanying drawings.

Figure 1:
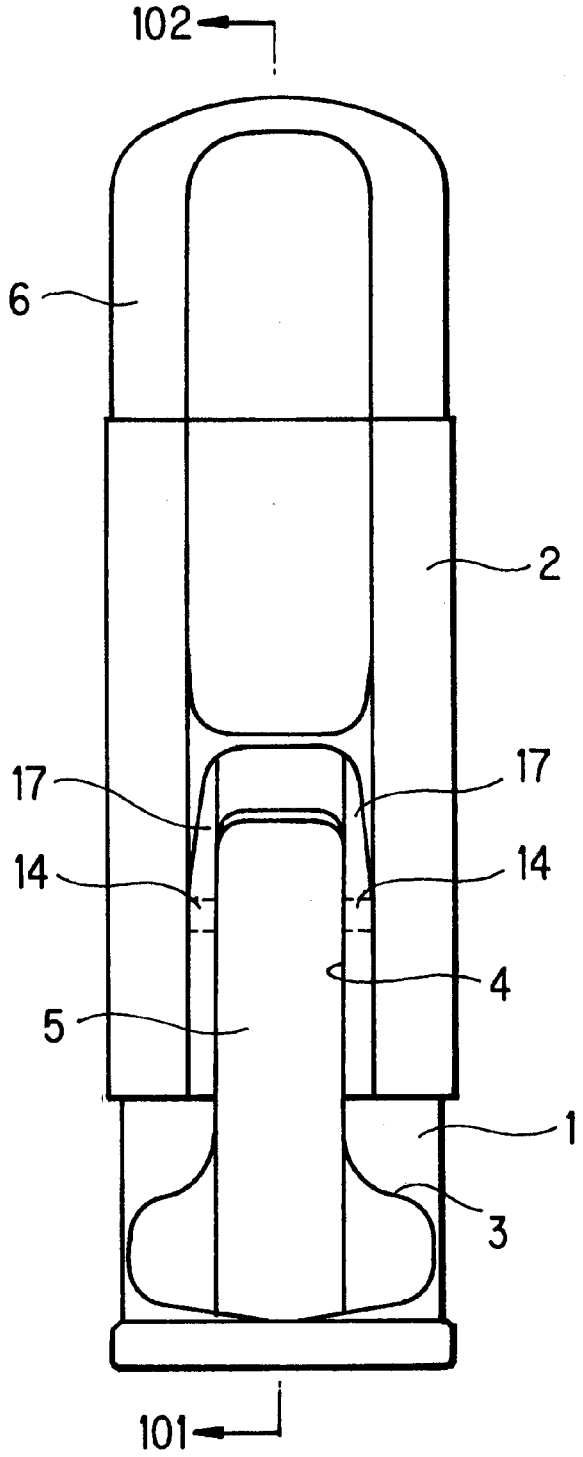
FIG. 1 is a side view showing a state where the lid is closed.

To begin with, as shown in FIG. 1, an inner cylinder 1 is enclosed by an outer cylinder 2 while the lower end of inner cylinder 1 is projected out downwards from the lower end opening of outer cylinder 2. This outer cylinder 2 is slidable in the vertical direction relative to inner cylinder 1. Inner cylinder 1 has a window hole 3 on the side thereof while outer cylinder 2 has a cutout portion 4 on the side thereof. A lid 5 is arranged at window hole 3 and cutout portion 4. A detachable cap 6 is attached to the upper end of outer cylinder 2. Here, the inner cylinder and the outer cylinder make up the barrel body.

Figure 5A:
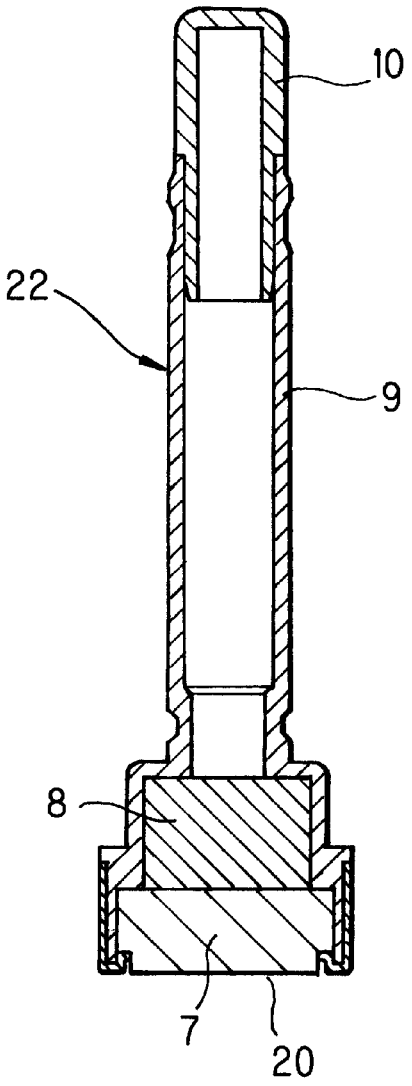
FIGS. 5A and 5B are sectional views showing stamping units.
Figure 5B:
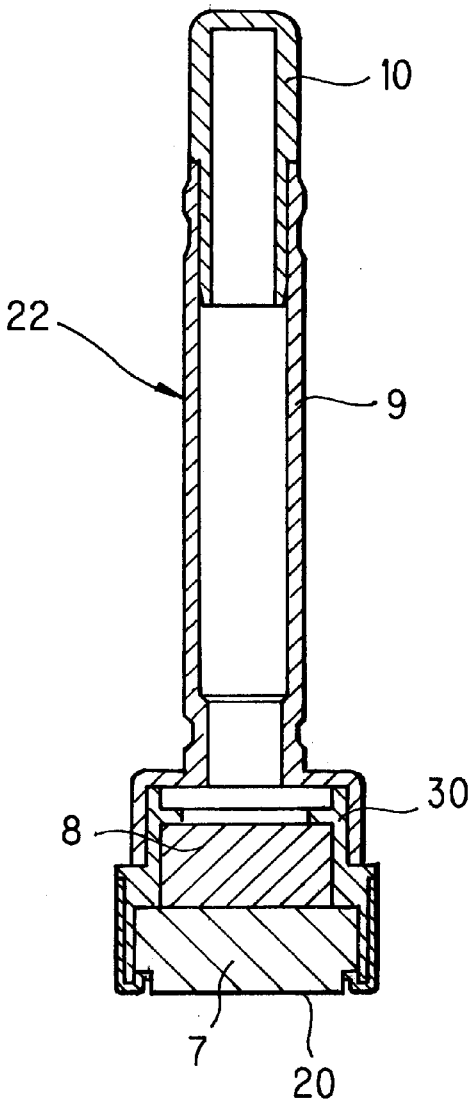

As shown in FIGS. 5A and 5B, a stamp unit 22 is configured of a middle cylinder 9 holding a stamping element 7 made up of a porous stamp compound having continuous pores and an ink retainer 8 at the lower end thereof and a plug 10.

Figure 2:
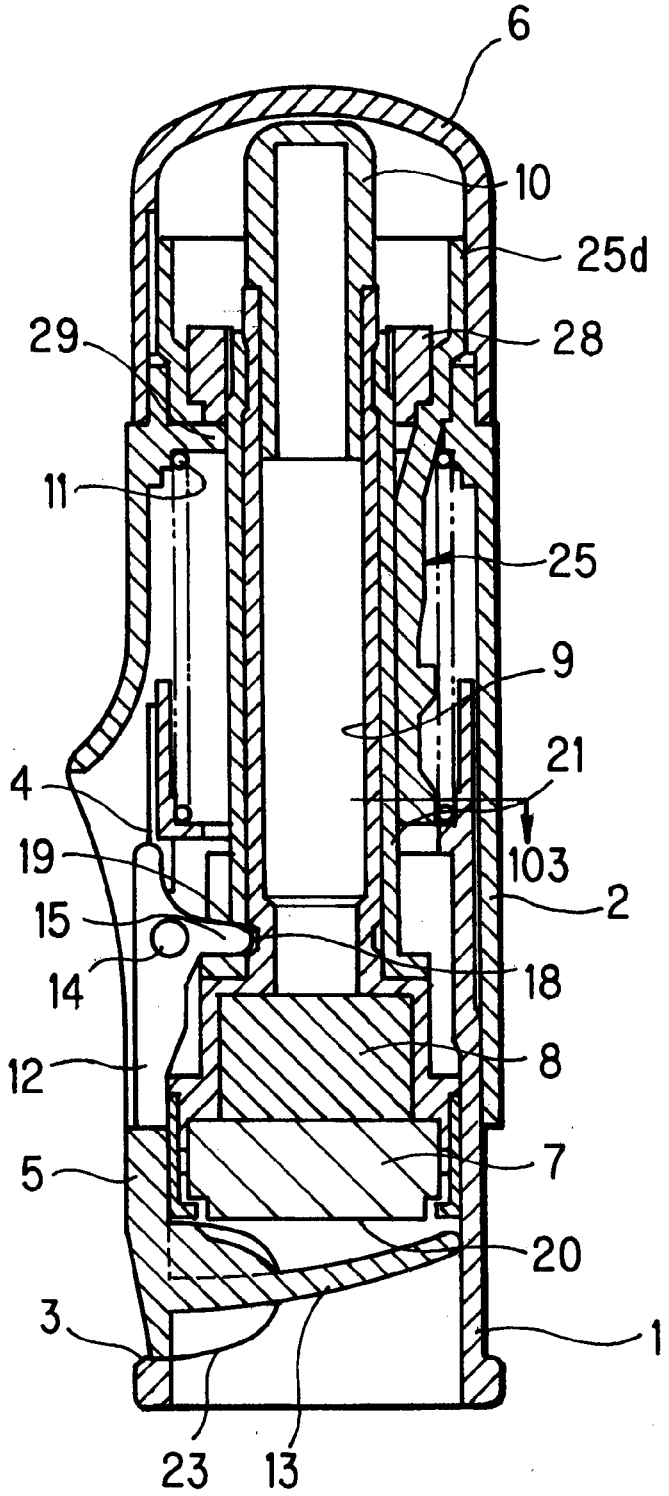
FIG. 2 is a sectional view cut along a line 101–102 in FIG. 1.

Referring next to FIG. 2, a supporting cylinder 21 open at the top and bottom thereof is arranged inside outer cylinder 2. Middle cylinder 9 holding stamping element 7 and ink retainer 8 at the its lower end is fitted through supporting cylinder 21 and fixed thereto. A locking cylinder 25 is provided enclosing supporting cylinder 21 while supporting cylinder 21 has a flange (not shown) at its rear portion which abuts the lower end of an inner stepped portion 29 of outer cylinder 2. A stopper ring 28 is fixed abutting the upper end of inner stepped portion 29. In this state, locking cylinder 25 is restricted with its stepped portion 25*e* held between inner stepped portion 29 of outer cylinder 2 and the front end of stopper ring 28. Here, locking cylinder 25 is attached so as to be rotatable within an appropriate range relative to outer cylinder 2. Detail of locking cylinder 25 will be described hereinafter.

As shown in FIG. 2, supporting cylinder 21 open at the top and bottom is arranged inside outer cylinder 2. Stamp unit 22 as shown in FIGS. 5A and 5B is fitted through this supporting cylinder 21 and attached.

The upper end portion of middle cylinder 9 of stamp unit 22 is projected out from the upper opening of supporting cylinder 21. Therefore, the upper end portion of middle cylinder 9 is pushed so that stamp unit 22 can readily be taken out from the lower end opening of supporting cylinder 21.

Middle cylinder 9 has removable plug 10 attached to the upper end thereof. When cap 6 is taken from outer cylinder 2, plug 10 attached to the upper end of middle cylinder 9 in stamp unit 22 is exposed. By removing this plug 10 from middle cylinder 9, ink can be injected from the upper end opening of middle cylinder 9 so as to replenish ink retainer 8 supported at the lower end of middle cylinder 9.

Ink retainer 8 and stamping element 7 are both configured of porous materials having continuous pores.

Provided between inner cylinder 1 and outer cylinder 2 is a spring 11 which urges outer cylinder 2 upwards with respect to inner cylinder 1.

Next, lid 5 is made up of an elongated rotary arm portion 12 extending in the vertical direction and a shield portion 13 projected approximately perpendicularly from the lower end of rotary arm portion 12. An axial support 14 projected sidewards as a rotary axis is provided at the upper end portion of arm portion 12 while a foot piece 15 is formed in the upper end portion of arm portion 12 so as to be projected on the inner side. This axial support 14 may be formed by holes or fitting a pin through holes corresponding to the attaching portion.

Figure 3:
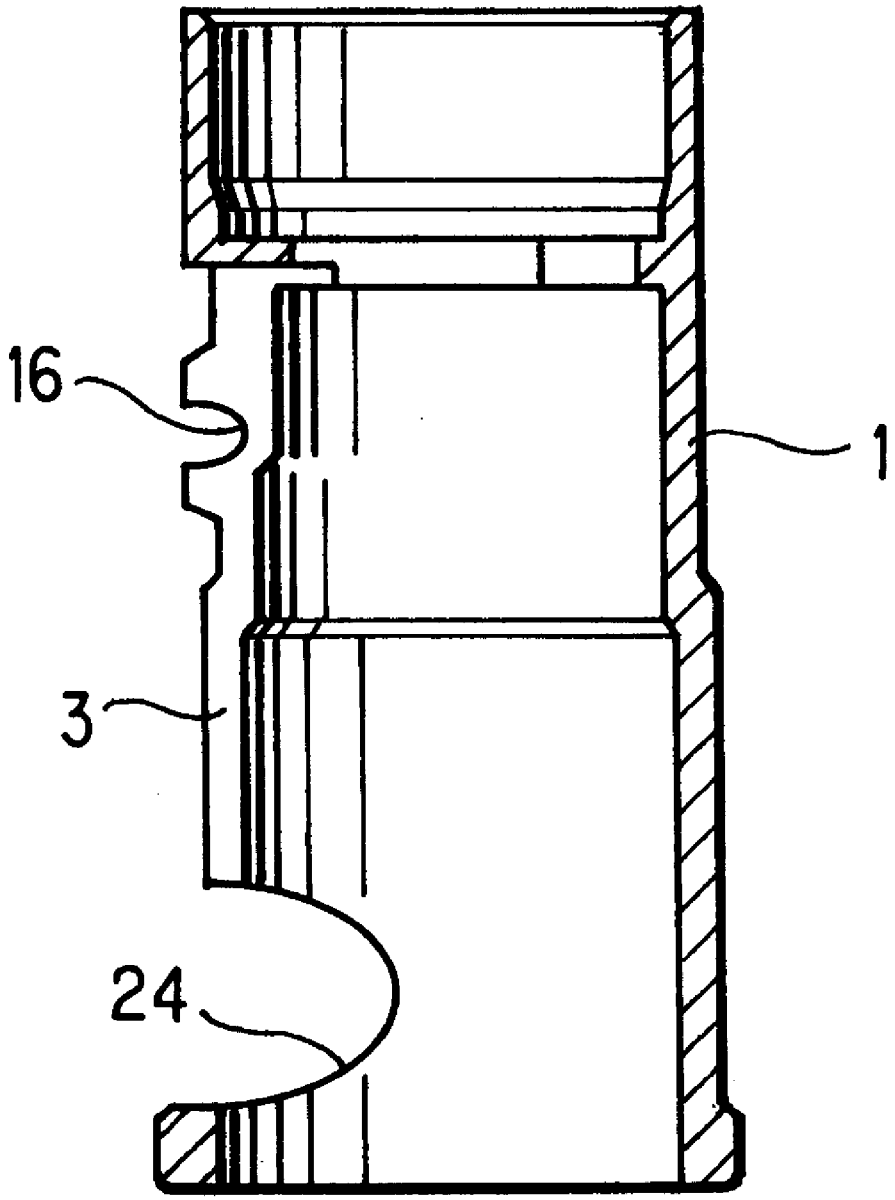
FIG. 3 is a sectional view showing an inner cylinder.
Figure 4:
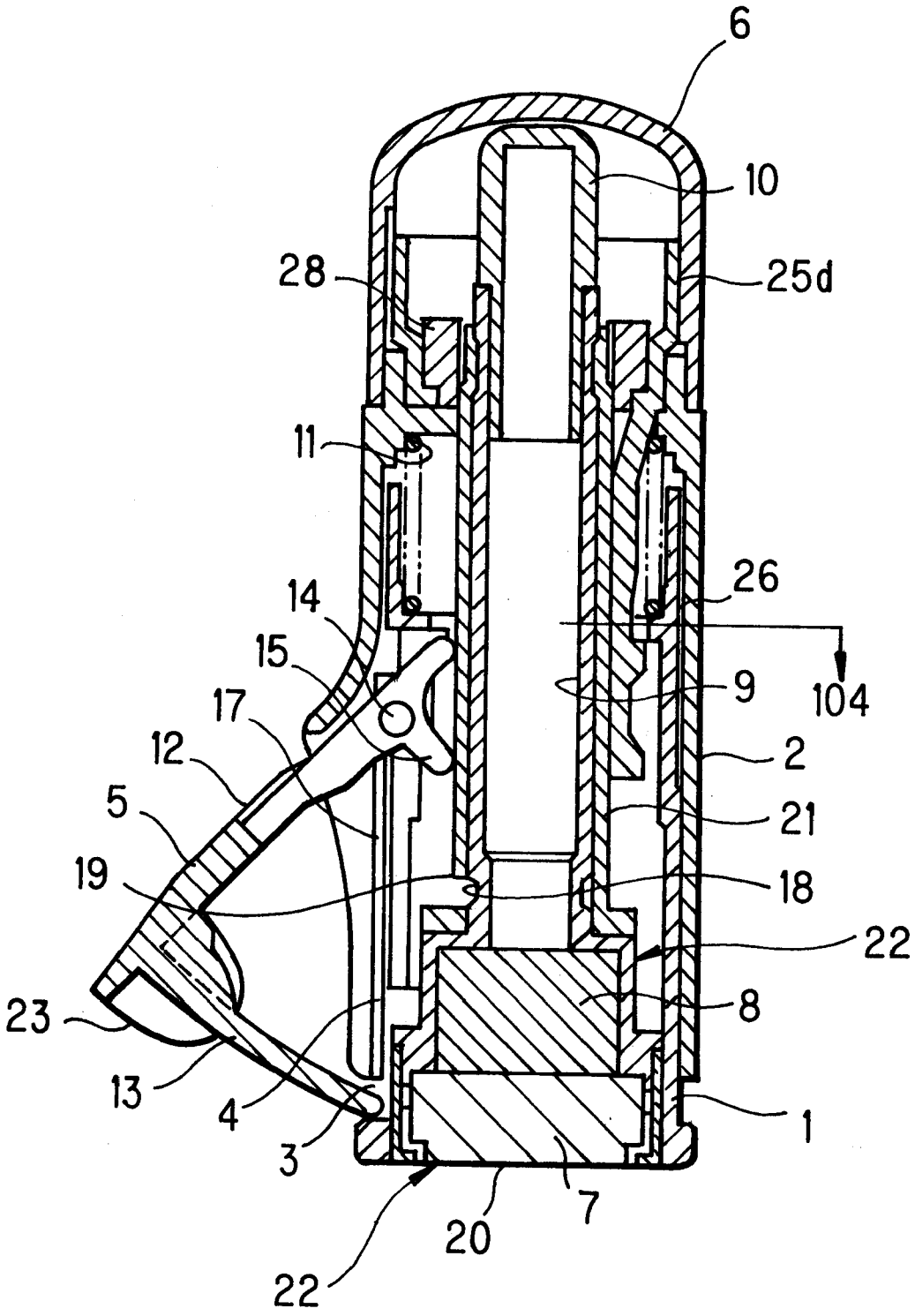
FIG. 4 is a sectional view showing a state where the lid is opened so as to allow for stamping.

In order to allow for free rotation of lid 5, a U-shaped groove 16 is formed at the frame of window hole 3 of inner cylinder 1 as shown in FIG. 3 while a cover portion 17 (c.f. FIG. 1 and FIG. 4) covering the outer side of U-shaped groove 16 is provided for the frame of cutout portion 4 of outer cylinder 2. For attachment of lid 5, axial support 14 of the rotary axis of lid 5 is fitted into U-shaped groove 16 of inner cylinder 1 before inserting inner cylinder 1 into outer cylinder 2, and then inner cylinder 1 is fitted into outer cylinder 2 so that cover portion 17 will enclose the outer side of U-shaped groove 16 to thereby prevent axial support 14 from dropping. Thus, lid 5 can be easily attached without being deformed.

Formed around the connection between shield portion 13 and arm portion 12 of lid 5 are side-walls having a projected ridgeline portion 23 while inner cylinder 1 is formed with a depressed ridgeline portion 24 which mates in substantially tight contact with projected ridgeline portion 23 formed on the lid 5. Provided on the side surface of middle cylinder 9 at the position opposing the inner face of arm portion 12 of lid 5 is a recessed portion 18 which receives the distal end of foot piece 15 projected from the inner face of arm portion 12 when lid 5 is closed. Further, in order to rotate arm portion 12 of lid 5, a presser portion 19 which abuts the upper face of foot piece 15 and presses foot piece 15 when moving downwards integrally with outer cylinder 2 is provided on the side face of supporting cylinder 21 holding middle cylinder 9, at a position slightly above that of recessed portion 18 of middle cylinder 9. This presser portion 19 may also be formed on the side face of middle cylinder 9.

As shown in FIG. 2, when outer cylinder 2 is pushed up with respect to inner cylinder 1 by the force of spring 11, lid 5 is closed so that shield portion 13 of lid 5 covers the lower portion of stamping element 7 and protects its stamping face 20.

When outer cylinder 2 is pushed down as spring 11 is becoming compressed with the lower end of inner cylinder 1 abutted against a document, etc., to be stamped, presser portion 19 of supporting cylinder 21 pushes foot piece 15 as stated above whereby rotary arm portion 12 rotates outwardly and lid 5 opens.

At this point, as shown in FIG. 4, shield portion 13 comes out of inner cylinder 1 and outer cylinder 2 to release the lower portion of stamping element 7 so that outer cylinder 2 can further be moved down and stamping face 20 of stamping element 7 will be exposed from the bottom opening of inner cylinder 1, allowing stamping. Here, the open state of lid 5 can be kept by the abutment of the distal end of foot piece 15 against the side face of supporting cylinder 21. When downward pushing force on outer cylinder 2 is released, the restoring force of spring 11 pushes up outer cylinder 2, whereby lid 5 automatically shuts and returns to the state shown in FIG. 2.

The above stamp unit 22 is configured so that stamping element 7 and ink retainer 8 are held at the lower end of middle cylinder 9 extended vertically with removable plug 10 attached at the upper end of middle cylinder 9. However, stamp unit 22 may have the configuration shown in FIG. 5B. Stamp unit 22 shown in FIG. 5B is configured so that a holder 30 holding ink retainer 8 and stamping element 7 is detachably disposed to the lower end of middle cylinder 9 with its upper end closed. Also in this case, stamp unit 22 is fitted through supporting cylinder 21 so that its upper end is projected from the upper end opening of supporting cylinder 21. Pressing the upper end allows the unit to be taken out from the lower end opening of supporting cylinder 21. When ink retainer 8 needs to be supplied with ink, holder 30 may be taken out from middle cylinder 9 and the ink can be injected from the top opening of holder 30.

Figure 6:
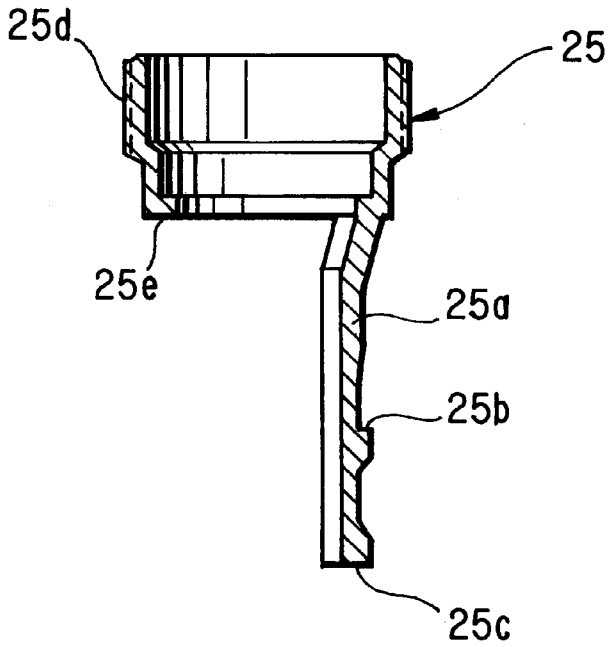
FIG. 6 is a sectional view showing a locking cylinder.
Figure 7:
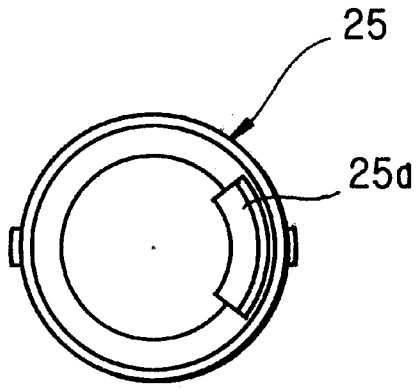
FIG. 7 is a side view showing a locking cylinder.

FIGS. 6 and 7 show a locking cylinder 25. Locking cylinder 25 includes an annular knob 25*d* at the upper end thereof, a stepped portion 25*e* below the knob and a stopper piece 25*a* extending downwards from the stepped portion 25*e*. Stopper piece 25*a* has a stepped portion 25*b* and an end portion 25*c* at its lower part on the peripheral surface of stopper piece 25*a*.

Figure 8:
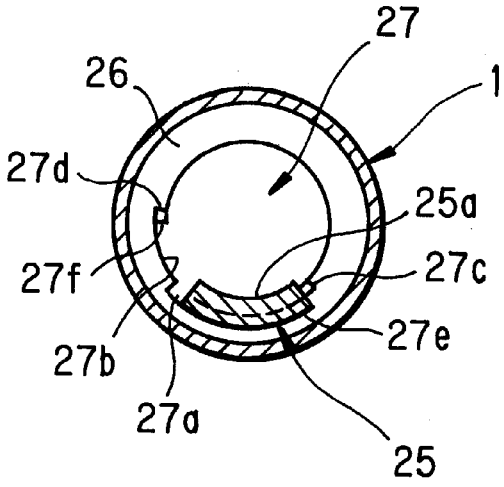
FIG. 8 is a view showing essential part, cut along a plane 103 and viewed in the direction of the arrow in FIG. 2.

FIG. 8 is a view showing essential part, cut along a plane 103 in FIG. 2. A partitioning wall 26 of inner cylinder 1 has a coaxial passage hole 27. Formed on the inner peripheral surface of the passage hole are a relatively deep peripheral groove 27*a* and a relatively shallow peripheral groove 27*b*. A projected portion 27*c* and abutment portion 27*e* are formed at one end while a projected portion 27*d* and abutment portion 27*f* are formed at the other end. In this state, stopper piece 25*a* of locking cylinder 25 is positioned loosely within groove 27*a* so that outer cylinder 2 can be moved downwards with respect to inner cylinder 1.

Figure 9:
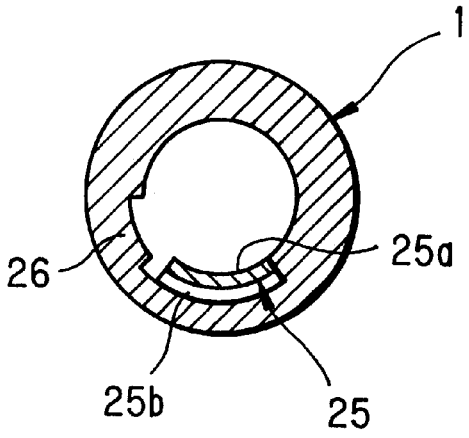
FIG. 9 is a view showing essential part, cut along a plane 104 and viewed in the direction of the arrow in FIG. 4.

FIG. 9 is a view showing essential part, cut along a plane 104 in FIG. 4. Also in this state, stopper piece 25*a* of locking cylinder 25 is positioned loosely within groove 27*a* so that outer cylinder 2 can be moved upwards with respect to inner cylinder 1.

That is, in the states shown in FIGS. 8 and 9, locking cylinder 25 is positioned with one side end of the front part of stopper piece 25*a* abutted on abutment portion 27*e* of groove 27*a* while outer cylinder 2 can be moved up and down with respect to inner cylinder 1 so as to allow lid 5 to be opened and closed.

Figure 10:
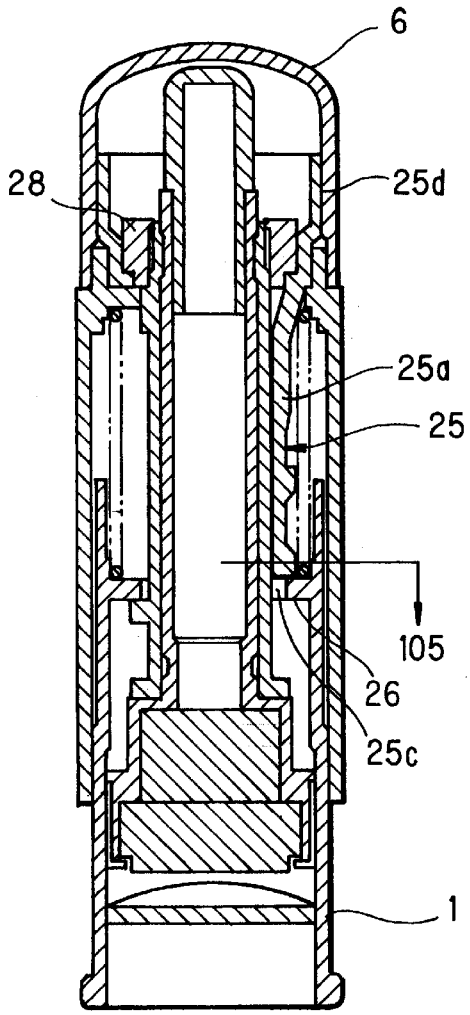
FIG. 10 is another sectional view corresponding to FIG. 2.
Figure 11:
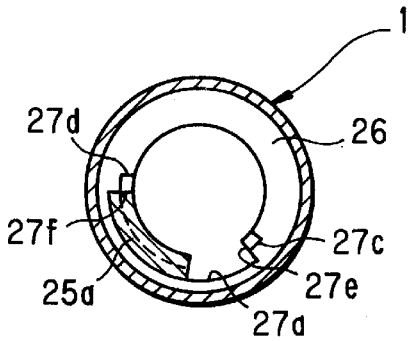
FIG. 11 is a view showing essential part, cut along a plane 105 and viewed in the direction of the arrow in FIG. 10.

FIG. 10 is another vertical sectional view corresponding to FIG. 2. FIG. 11 is a view showing essential part, cut along a plane 105 in FIG. 10. In this state, locking cylinder 25 has been rotated and is positioned with its one end abutted on abutment portion 27*f* of groove 27*b* while end portion 25*c* of locking cylinder 25 overlaps partitioning wall 26 so that the downward movement of outer cylinder 2 relative to inner cylinder 1 is prohibited. As a result, this state will not allow for opening of lid 5.

Figure 12:
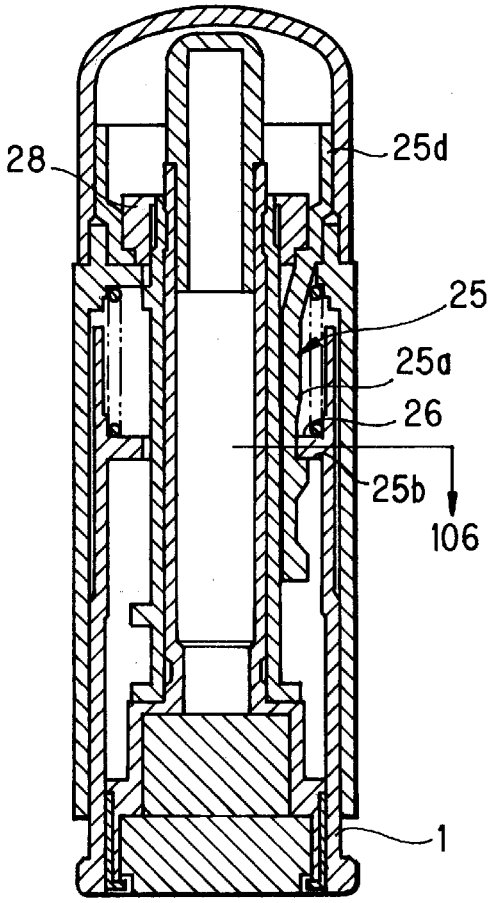
FIG. 12 is another sectional view corresponding to FIG. 4.
Figure 13:
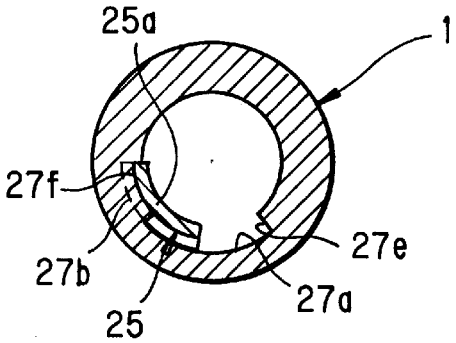
FIG. 13 is a view showing essential part, cut along a plane 106 and viewed in the direction of the arrow in FIG. 12.

FIG. 12 is another vertical sectional view corresponding to FIG. 4. FIG. 13 is a view showing essential part, cut along a plane 106 in FIG. 12. In this state, locking cylinder 25 has been rotated and is positioned with its one end abutted on abutment portion 27*f* of groove 27*b* while stepped portion 25*b* of locking cylinder 25 overlaps partitioning wall 26 so that the upward movement of outer cylinder 2 relative to inner cylinder 1 is prohibited. As a result, this state will not allow for closing of lid 5.

Here, the outer periphery of stopper ring 28 of locking cylinder 25 is engaged integrally with the inner periphery of cap 6, with respect to the rotational direction so that locking cylinder 25 can be rotationally linked with outer cylinder 2 when cap 6 is rotated.

Alternatively, other than the above embodiment, the rotational positioning of locking cylinder 25 can be attained by providing a peripheral groove (not shown) on the peripheral surface of the passage hole of inner stepped portion 29 formed in the upper part of outer cylinder 2 so that the side edges of stopper piece 25*a* of locking cylinder 25 are limited by their abutment against the corresponding groove ends.

As has been described heretofore, since the present invention is configured so that the lid will automatically open by the operation of pressing the outer cylinder downwards, there is no necessity for such tedious handling as opening the lid and hence there is no concern that the operator's hands will be smudged with ink because there is no chance of the operator touching the stamping face. Further, there is no risk of the lid being lost. Since the lid is opened and closed by its rotational movement, the lid can be smoothly opened and closed without any fear that the lid may be deformed and disrupted. When the lid is assembled, the axial support of the lid is fitted into the U-shaped groove of the inner cylinder and then the inner cylinder can be inserted into the outer cylinder. Therefore, this configuration facilities easy assembly without forcibly deforming the lid.

According to the present invention, a stamp unit is configured so as to have a stamping element and an ink retainer held at the lower end of a middle cylinder. The stamp unit is detachably disposed to a supporting cylinder of the barrel body. Therefore, the stamp unit is detached from the supporting cylinder so as to allow for easy ink supply to the ink retainer as well as enabling easy replacement of the stamping element. Further, since the upper end of the middle cylinder is arranged so as to project from the upper end opening of the supporting cylinder when the cap has been removed from the barrel body, this configuration offers the convenience of pressing the upper end of the middle cylinder so that easy detachment of the stamp unit from the lower end opening of the supporting cylinder can be facilitated.

The above configuration of the present invention allows for easy replenishment of the ink retainer with ink by removing the plug from the upper end of the middle cylinder and injecting ink from the upper end opening of the middle cylinder.

Further, according to the present invention, provision of a spring as stated above enables automatic return of the outer cylinder and an automatic closing movement of the lid.

Since the stamping implement can be locked so that the lid will not open unintentionally when it is hand-carried, it is possible to eliminate the problem of the user being smudged with ink and the problem of the stamping face being damaged or dirtied.

Moreover, when the stamping element needs to be refilled with ink or when the stamp unit as a whole needs to be replaced, the lid can be locked while it is open. Therefore, the work can be readily performed.

The thin-walled, delicate shield portion can be reinforced and shaped so as not to be damaged while it is still possible to provide a good looking, stamping implement having an openable/closable lid.

What is claimed is:

1. A stamping implement comprising:

a stamp unit having a stamping element made up of a porous stamp compound having continuous pores at the lower end thereof;

an outer cylinder having an opening at the lower end thereof, a cutout portion on the side thereof and the stamp unit fixed therein;

an inner cylinder having an opening at the lower end thereof a window hole on the side thereof and being arranged outside the stamp unit and inside the outer cylinder with the lower end thereof projected out below the lower end of the outer cylinder so as to be slidable in the vertical direction relative to the outer cylinder; and a lid configured of an arm portion pivoted at an axial support near the upper end thereof and a shield portion at the lower end of the arm portion, characterized in that the axial support of the lid is axially supported so as to be rotatable by a frame of the window hole of the inner cylinder, and the lid rotates in linkage with the vertical movement of the inner cylinder relative to the outer cylinder, whereby the lower face of the stamping element is shielded when the lid is closed while the lower face of the stamping element is capable of being released when the lid is open.

2. The stamping implement according to claim 1, further comprising: a supporting cylinder opening at both upper and lower ends disposed inside the outer cylinder; a middle cylinder for a stamp unit removably fitted through the supporting cylinder, the upper end of the middle cylinder being projected above the upper end of the supporting cylinder; and a removable cap attached to the upper end of the outer cylinder.

3. The stamping implement according to claim 1, further comprising: a U-shaped groove for receiving the axial support of the lid, formed in the frame of the window hole of the inner cylinder; and a cover portion disposed over the frame of the cutout portion of the outer cylinder so as to cover the outside of the U-shaped groove for preventing the axial support from coming off.

4. The stamping implement according to claim 1, wherein a presser portion which abuts and presses the foot piece of the lid in the lid's opening direction when the outer cylinder moves down is provided on the side surface of the supporting cylinder.

5. The stamping implement according to claim 1, wherein side-walls having a projected ridgeline portion are formed around the connection between the shield portion and arm portion of the lid; and the inner cylinder is formed with a depressed ridgeline portion which mates in substantially tight contact with the projected ridgeline portion formed on the lid.

6. The stamping implement according to claim 1, further comprising a locking mechanism between the inner cylinder and outer cylinder for stopping the vertical movement of the inner cylinder relative to the outer cylinder when the lid is open and when the lid is closed.

7. The stamping implement according to claim 6, wherein the locking mechanism comprises: a partitioning wall formed on the inner periphery of the inner cylinder; and a locking cylinder disposed in the upper part of the outer cylinder so as to be rotatable within an appropriate range relative to the outer cylinder, and the partitioning wall becomes engaged with the locking cylinder when the locking cylinder is rotated in the lid open or closed state, so that the vertical movement of the inner cylinder relative to the outer cylinder is prohibited.

* * * * *